US010739117B2

(12) United States Patent
Chia et al.

(10) Patent No.: US 10,739,117 B2
(45) Date of Patent: Aug. 11, 2020

(54) FOAM DART HAVING A SAFETY CAP

(71) Applicant: Easebon Services Limited, Kwun Tong (HK)

(72) Inventors: Francis See Chong Chia, Kowloon (HK); Xubin Xia, Guangdong (CN)

(73) Assignee: EASEBON SERVICES LIMITED, Kwun Tong (HK)

( * ) Notice: Subject to any disclaimer, the term of this patent is extended or adjusted under 35 U.S.C. 154(b) by 0 days.

(21) Appl. No.: 16/743,550

(22) Filed: Jan. 15, 2020

(65) Prior Publication Data

US 2020/0149847 A1 May 14, 2020

Related U.S. Application Data

(63) Continuation of application No. 16/444,567, filed on Jun. 18, 2019, now Pat. No. 10,551,156, which is a continuation of application No. 16/259,224, filed on Jan. 28, 2019, now Pat. No. 10,371,492, which is a continuation of application No. 16/008,699, filed on Jun. 14, 2018, now Pat. No. 10,222,184, which is a continuation of application No. 15/793,429, filed on Oct. 25, 2017, now Pat. No. 10,030,950.

(51) Int. Cl.

| | |
|---|---|
| ***F42B 6/00*** | (2006.01) |
| ***F42B 6/08*** | (2006.01) |
| ***F42B 12/74*** | (2006.01) |

(52) U.S. Cl.

CPC ..... *F42B 6/08* (2013.01); *F42B 6/003* (2013.01); *F42B 12/745* (2013.01)

(58) Field of Classification Search

CPC ..... F42B 6/003; F42B 6/08; F42B 12/745

USPC ..... 473/572, 578, 582

See application file for complete search history.

(56) References Cited

U.S. PATENT DOCUMENTS

| | | | | |
|---|---|---|---|---|
| 2,377,498 A * | 6/1945 | Jacke | A63B 67/086 | 473/569 |
| 3,418,995 A * | 12/1968 | Heller | A63H 27/005 | 124/27 |
| 3,801,102 A * | 4/1974 | Lohr | F42B 6/003 | 473/572 |
| 5,928,049 A * | 7/1999 | Hudson | A63H 27/004 | 446/15 |
| 6,083,127 A * | 7/2000 | O'Shea | A63H 33/18 | 446/213 |
| 7,775,918 B2 * | 8/2010 | Tsang | F42B 6/10 | 473/572 |

(Continued)

*Primary Examiner* — Alexander R Niconovich

(74) *Attorney, Agent, or Firm* — Amster, Rothstein & Ebenstein LLP

(57) ABSTRACT

A toy dart includes a deformable cap that safely impacts a target. The cap includes two layers of substantially parallel hollow passages that provide spaces that allow the cap to deform. The lower layer, having two hollow passages, is supported by exterior posts and an interior wall between the two hollow passages. The upper layer, having three hollow passages, is supported by exterior posts and interior walls that are laterally offset from the interior wall of the lower layer. The upper and lower layers are separated vertically by a substantially flat divider. Due to the difference in the number of hollow passages and interior walls in each layer, the upper layer is more rigid than the lower layer such that the lower layer of the cap deforms more than the upper layer of the cap upon initial impact with the target.

20 Claims, 6 Drawing Sheets

(56) References Cited

U.S. PATENT DOCUMENTS

| | | | | |
|---|---|---|---|---|
| 7,861,657 | B2 * | 1/2011 | Danon | F42B 12/34 102/502 |
| 8,012,049 | B1 * | 9/2011 | Walterscheid | F42B 6/08 473/572 |
| 8,449,413 | B1 * | 5/2013 | Jackson | F42B 6/08 473/578 |
| 8,616,934 | B1 * | 12/2013 | Kern | A63H 37/00 446/400 |
| 8,852,038 | B1 * | 10/2014 | Hyde | F42B 6/04 473/578 |
| 9,261,336 | B2 * | 2/2016 | Chang | F42B 6/003 |
| 9,435,621 | B1 * | 9/2016 | Yeh | F42B 6/08 |
| D802,681 | S * | 11/2017 | Falkowski, II | A63H 27/004 D21/387 |
| 10,018,451 | B1 * | 7/2018 | Ma | F42B 6/003 |
| 10,018,452 | B1 * | 7/2018 | Ma | F42B 6/003 |
| 2004/0069177 | A1 * | 4/2004 | Klein | F42B 12/36 102/502 |
| 2006/0014598 | A1 * | 1/2006 | Martin | F42B 6/08 473/578 |
| 2006/0046877 | A1 * | 3/2006 | Gajda, Jr. | F42B 6/10 473/572 |
| 2006/0276277 | A1 * | 12/2006 | Montefusco | F42B 8/16 473/586 |
| 2015/0018143 | A1 * | 1/2015 | Chia | F42B 6/003 473/582 |
| 2015/0018144 | A1 * | 1/2015 | Chia | F42B 12/34 473/582 |
| 2018/0051966 | A1 * | 2/2018 | Isenmann | F42B 6/08 |
| 2018/0292188 | A1 * | 10/2018 | Isenmann | F42B 6/08 |

* cited by examiner

FOAM DART HAVING A SAFETY CAP

CROSS-REFERENCE TO RELATED APPLICATIONS

This application is a continuation of and claims the benefit of and priority to co-pending U.S. patent application Ser. No. 16/444,567, filed Jun. 18, 2019, which is a continuation of and claims the benefit of and priority to U.S. patent application Ser. No. 16/259,224, filed Jan. 28, 2019 and issued as U.S. Pat. No. 10,371,492 on Aug. 6, 2019, which is a continuation of and claims the benefit of and priority to U.S. patent application Ser. No. 16/008,699, filed Jun. 14, 2018 and issued as U.S. Pat. No. 10,222,184 on Mar. 5, 2019, which is a continuation of and claims the benefit of and priority to U.S. patent application Ser. No. 15/793,429, filed Oct. 25, 2017 and issued as U.S. Pat. No. 10,030,950 on Jul. 24, 2018, which are incorporated herein by reference as if fully set forth herein.

FIELD

The present invention is generally related to an improved toy dart that includes a foam body and a safety cap.

BACKGROUND

Manufacturers have been making various types of toy darts, such as a dart having a foam body and a cap attached to one end of the dart body, that may be launched with a compatible toy dart launcher toward a person or an object. The caps of the toys darts are generally made of a material other than foam that allows the dart to be shot from the launcher at a targeted person or object and/or propelled over an appropriate distance and/or at a relatively quick speed. It is important to achieve at least one or more of these objectives with varying degrees of importance, without injuring, or at least limiting the injury or discomfort felt by, the targeted person or object.

Maintaining safety has become more challenging as customers want to have improved darts that are even more accurate, travel at even faster speeds, and/or travel over even longer distances. At the same time, toy darts must also meet government-mandated safety requirements that are tightened from time to time. For example, in the United States, ASTM F 963-16, The Standard Consumer Safety Specification for Toy Safety, is currently mandated by the U.S. Consumer Product Safety Commission. This Standard specifies a Kinetic Energy Density (KED) test with a maximum of 2500 J/m$^2$ (Joules/meter square) for projectile toys. Thus, consumer demands for improvements in toy dart performance require new toy dart designs that are safe.

What is needed is an improved foam dart toy, which can meet performance specifications regarding distance, speed and/or accuracy while at the same time maintaining appropriate safety precautions to avoid and/or limit injuries upon impact.

SUMMARY

The present invention is generally related to an improved toy dart that includes a foam body and a safety cap.

In accordance with an embodiment of the present invention, a toy dart has an elongate dart body, which may comprise foam, having an in bore extending from a head end to a tail end of the elongate dart body in a first, longitudinal direction, and a deformable dart cap affixed to the head end of the elongate dart body. The deformable dart cap has a top, a bottom that is affixed into the interior bore at the head end of the elongate dart body, and a substantially cylindrically-shaped outer surface extending from the top to the bottom of the deformable dart cap in the first, longitudinal direction. The substantially cylindrically-shaped outer surface of the deformable dart cap has two layers of hollow passages, each of the hollow passages extending from a respective first opening on the substantially cylindrically-shaped outer surface through the deformable dart cap in a second direction, to a respective second opening on the substantially cylindrically-shaped outer surface, wherein the second direction is substantially orthogonal to the first, longitudinal direction of the elongate dart body. The two layers of hollow passages include (1) a lower layer, in proximity to the bottom of the deformable dart cap, that has at least two of the hollow passages extending through the deformable dart cap and a lower layer interior boundary between the at least two hollow passages of the lower layer; (2) an upper layer, above the lower layer and covered by the top of the deformable dart cap, that has at least three of the hollow passages extending through the deformable dart cap, wherein the upper layer interior boundaries between the at least three hollow passages of the upper layer are offset in position laterally from the lower layer interior boundary between the at least two hollow passages of the lower layer; and (3) a substantially flat divider separating the upper and lower layers that is also substantially orthogonal to the longitudinal direction of the elongate dart body. The deformable dart cap is deformable so as to substantially prevent or limit injuries that may be caused by impact of the toy dart on a person or object. In embodiments, the elongate dart body of the toy dart is substantially cylindrical.

In embodiments, the upper and lower layers of the deformable dart cap include two exterior posts, each extending longitudinally along the outer surface of the deformable dart cap and spaced approximately 180 degrees from one another.

In embodiments, the at least two of the hollow passages of the lower layer of the deformable dart cap are adjacent and substantially parallel to one another, and are separated from one another by a first interior wall that provides the lower layer interior boundary therebetween. In these exemplary embodiments, the upper and lower layers of the deformable dart cap may be connected to one another by two exterior posts, each extending longitudinally along the outer surface of the deformable dart cap and spaced approximately 180 degrees from one another, and the first interior wall may be located substantially midway between the two exterior posts such that there is support for the lower layer radially at approximately every 90 degrees about a circumference of the deformable dart cap.

In embodiments, the at least two of the hollow passages of the lower layer of the deformable dart cap are approximately equal in cross section.

In embodiments, at least three of the hollow passages of the upper layer include two outer hollow passages and a third, inner hollow passage situated between the two outer hollow passages, and the two outer hollow passages and the third, inner hollow passage are substantially parallel to one another. Also, in embodiments, the two outer hollow passages are approximately equal in cross-section, and the third, inner hollow passage has a larger cross section than each of the respective cross-sections of the two outer hollow passages.

In embodiments, the upper layer of the deformable dart cap further includes a second interior wall located at a first position between a first of the two outer hollow passages and the third, inner hollow passage, and a third interior wall located at a second position between a second of the two outer hollow passages and the third, inner hollow passage, wherein the second and third interior walls provide the upper layer interior boundaries between the at least three hollow passages of the upper layer. In embodiments, the first interior wall is positioned in the lower layer to be laterally offset from the first position of the second interior wall and the second position of the third interior wall in the upper layer such that the lower layer of the deformable dart cap is configured to compress more than the upper layer of the deformable dart cap upon initial impact of the top of the toy dart on the person or on an object. The third interior wall of the lower layer may be positioned below and substantially midway between the first and second interior walls of the upper layer. In embodiments, the upper layer of the deformable dart cap has a greater number of hollow passages and interior boundaries (e.g., interior walls) than the lower layer of the deformable dart cap such that the upper layer is more rigid than the lower layer.

The deformable dart cap may be made of one or more materials such as thermoplastic rubber (TPR) that is injection molded. In embodiments, the deformable dart cap includes a material with a Shore A durometer that is within a range of between 20 to 40 or that is approximately 30. Moreover, in embodiments, the deformable dart cap has a Shore A durometer that is within a range of between 20 to 80, is within a range of between 40 to 70, or is approximately 70.

In embodiments, the deformable dart cap further includes a stem extending therefrom that is configured for insertion into the interior bore of the elongate dart body to affix the bottom of the deformable dart cap into the interior bore at the head end of the elongate dart body. The stem may include one or more grooves for placement of adhesive to bond the deformable dart cap to the elongate dart body.

In embodiments, the top of the deformable dart cap may be curved, or may be shaped as a spherical segment, spherical frustum, or spherical dome, while in other exemplary embodiments, the top of the deformable dart cap is substantially flat. The top of the deformable dart cap may have a diameter of approximately 12.5 mm.

In another exemplary embodiment of the present invention, the deformable dart cap further includes a suction cup at the top of the deformable dart cap.

In another exemplary embodiment of the present invention, a toy dart has an elongate dart body that has an interior bore extending from a head end to a tail end of the elongate dart body in a first, longitudinal direction; and a deformable dart cap affixed to the head end of the elongate dart body. The deformable dart cap has three tiers, including a first tier, a substantially flat second tier, and a third tier, each of the three tiers being substantially circular in cross-section and substantially parallel to one another axially in the first, longitudinal direction. The first tier is attached to the substantially flat second tier with a first set of at least two exterior posts and a first interior wall that form first and second hollow passages between the first tier and the substantially flat second tier, the first and second hollow passages each extending substantially parallel to one another in a second direction of the deformable dart cap that is substantially orthogonal to the first, longitudinal direction, wherein the first set of at least exterior posts are spaced from one another by approximately 180° The substantially flat second tier is attached to the third tier with a second set of at least two exterior posts, and second and third interior walls that form third, fourth, and fifth hollow passages positioned above the first and second hollow passages between the substantially flat second tier and the third tier, the third, fourth and fifth hollow passages each extending substantially parallel to one another in the second direction. The second set of at least two exterior posts are substantially in alignment with the first set of at least two exterior posts. The second and third interior walls are in respective positions that are offset laterally from a position of the first interior wall such that the first interior wall is not substantially in alignment with the second or third interior walls. The deformable dart cap is deformable so as to substantially prevent or limit injuries that may be caused by impact of the toy dart on a person or object.

In embodiments, the first and second hollow passages are approximately equal in cross section. In embodiments, the third and fifth hollow passages are approximately equal in cross-section, and the fourth hollow passage is located between the third and fifth hollow passages and has a larger cross section than the cross-section of the third and fifth hollow passages.

The deformable dart cap may be made of one or more materials such as thermoplastic rubber (TPR) that is injection molded. In embodiments, the deformable dart cap includes a material with a Shore A durometer that is within a range of between 20 to 40 or that is approximately 30. Moreover, in embodiments, the deformable dart cap has a Shore A durometer that is within a range of between 20 to 80, is within a range of between 40 to 70, or is approximately 70.

In embodiments, the deformable dart cap further includes a stem extending therefrom that is configured for insertion into the interior bore of the elongate dart body to affix the bottom of the deformable dart cap into the interior bore at the head end of the elongate dart body. The stem may include one or more grooves for placement of adhesive to bond the deformable dart cap to the elongate dart body.

In embodiments, a top of the deformable dart cap may be curved, or may be shaped as a spherical segment, spherical frustum, or spherical dome, while in other embodiments, the top of the deformable dart cap is substantially flat. The top of the deformable dart cap may have a diameter of approximately 12.5 mm.

In another exemplary embodiment of the present invention, the deformable dart cap further includes a suction cup at the top of the deformable dart cap.

BRIEF DESCRIPTION OF THE DRAWINGS

Exemplary embodiments of the present invention will be described with references to the accompanying figures, wherein.

DETAILED DESCRIPTION

The present invention is generally related to an improved toy dart, such as a foam dart that may be used in a compatible toy dart launcher. The toy dart has an elongate dart body and a cap that is affixed to the dart body, where the cap has a configuration that enables the dart to accurately target a person or object and travel a relatively long distance, while impacting the target in a safe manner.

Figure 1A:
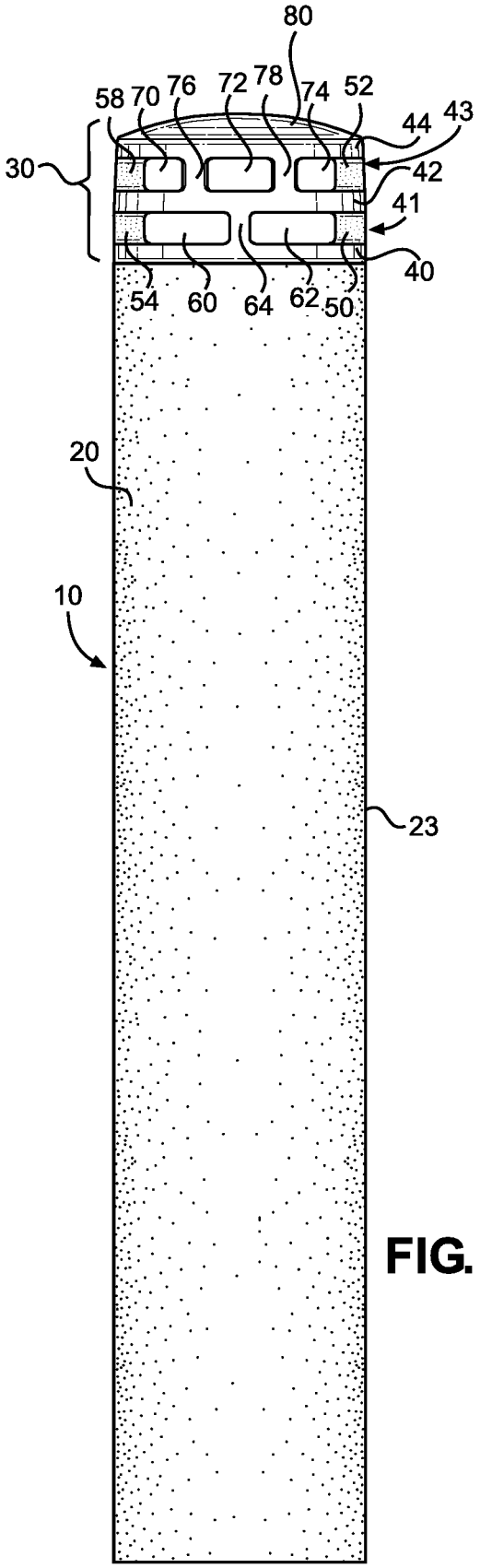
FIG. 1A is a plan view of a dart with a cap where the dart is displayed in a first angular orientation in accordance with an embodiment of the present invention.

Referring to FIG. 1A, a dart 10 in accordance with exemplary embodiments of the present invention has an elongate profile configured for aerodynamic flight toward a target, such as toward a person or other object. In embodiments, dart 10 may have a length of about, e.g., within a range of 55 mm and 75 mm, such as 59 mm, 65 mm, 67 mm, 70 mm, 73 mm, or 74 mm, to name a few. In embodiments, dart 10 may have an outer cross-sectional diameter at its widest point of, for example, 12.5 mm, 13 mm, 14 mm, or 15 mm, to name a few. Further, in embodiments, dart 10 may have other lengths, widths, and/or diameters.

Figure 3A:
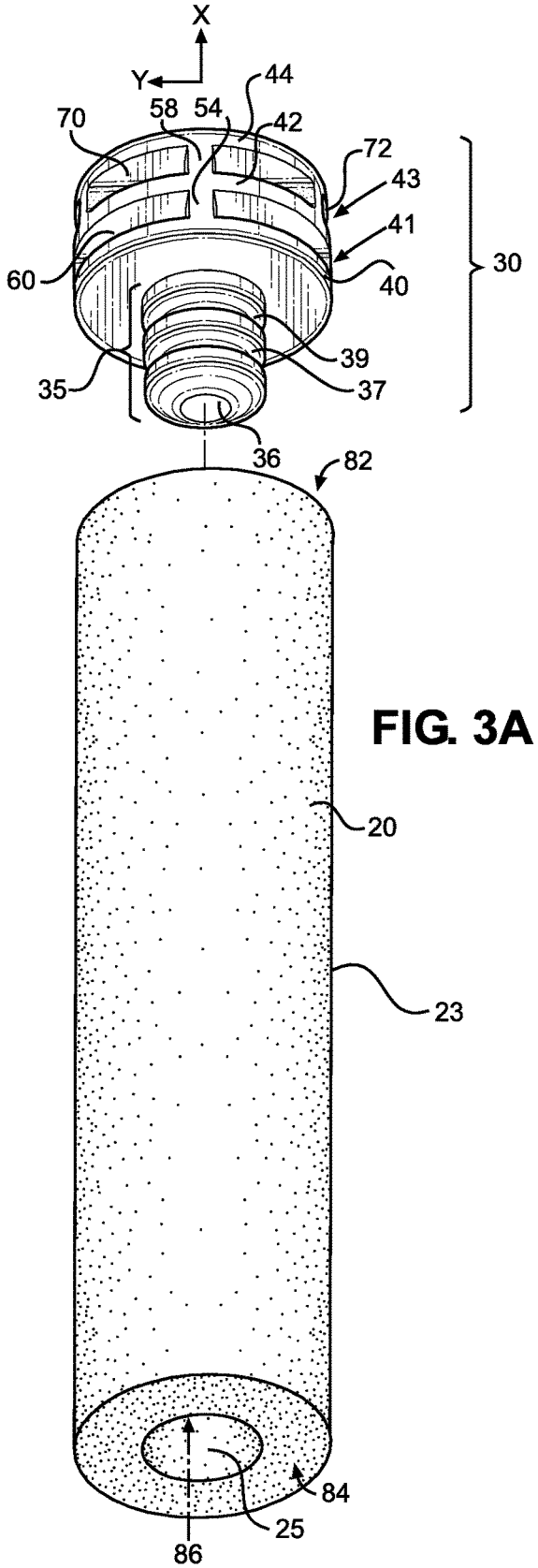
FIG. 3A is an exploded view of the dart, including a dart body and dart cap, shown from a first perspective with the dart cap in the orientation of FIG. 2A in accordance with an embodiment of the present invention.

Dart 10 includes an elongate dart body 20 that extends from a first end (a head end) 82 to a second end (a tail end) 84 of the elongate dart body 20 in a first, longitudinal direction x (see FIG. 3A). Dart 10 further includes a dart cap 30 that is affixed to the head end of the dart body 20.

Elongate dart body 20 includes a lightweight material, such as a foam, that is suitable for use in a toy projectile and has an interior bore 25. Referring to FIGS. 1A and 3A, dart body 20 is illustrated as having, for example, an outer surface 23 that is substantially cylindrical in shape and interior bore 25 (or interior core) that is also cylindrical in shape with a circular cross-section. In embodiments, interior bore 25 may have a diameter that at its widest point is, for example, 5 mm, 5.5 mm, or 6 mm, to name a few. However, in embodiments, interior bore 25 may have a different diameter. Alternatively, elongate dart body 20 and/or interior bore 25 may have a different cross-sectional shape, such as an oval, pyramidal, diamond, heptagonal, or octagonal shape. Interior bore 25 may extend entirely or at least partially through dart body 20. In embodiments, interior bore 25 of dart body 20 may be lined with materials that provide dart body 20 with certain mechanical properties, e.g., rigidity or resiliency. In exemplary embodiments, the dart body 20 may be formed of one or more pieces.

Dart cap 30 is affixed to the head end of the dart body 20. In exemplary embodiments, dart cap 30 has three tiers of material, including a first tier 40, a substantially flat second tier 42, and a third tier 44, each of the three tiers 40, 42, 44 being substantially circular in cross-section and substantially parallel to one another axially in the longitudinal direction (e.g., along the x axis shown in FIG. 3A). First tier 40, which is at or toward a bottom of cap 30, is attached to the substantially flat second tier 42 with a first set of at least two exterior posts 50, 54 and a first interior wall 64 that forms separate first and second hollow passages 60, 62 between the first tier 40 and the substantially flat second tier 42. First interior wall 64 serves as a lower layer interior boundary between hollow passages 60, 62. First and second hollow passages 60, 62, which may be approximately equal in cross-section, each extend laterally from one side of dart cap 30 to an opposite side of dart cap 30 and are substantially parallel to one another in a second direction y of the dart cap 30 that is substantially orthogonal to the first, longitudinal direction x (see FIG. 3A). Hollow passages 60, 62 may be viewed as extending into dart cap 30 in FIG. 1A and as extending out of dart cap 30 in FIG. 1B or vice versa. The first set of exterior posts 50, 54 are spaced from one another by approximately 180 degrees.

The substantially flat second tier 42 of dart cap 30 is attached to the third tier 44 with a second set of at least two exterior posts 52, 58, and second and third interior walls 76, 78 that form third, fourth, and fifth hollow passages 70, 72, 74 between the substantially flat second tier 42 and the third tier 44. Second and third interior walls 76, 78 serve as upper layer interior boundaries between hollow passages 70, 72, 74. Each of the third, fourth and fifth hollow passages 70, 72, 74 extends substantially parallel to one another in the second direction (they direction in FIG. 3A) and, in embodiments, are substantially parallel to hollow passages 60, 62. In embodiments, the third and fifth hollow passages 70, 74 are outer hollow passages that may be approximately equal in cross-section and may be larger, approximately the same as, or smaller than the cross-section of inner (fourth) hollow passage 72. In the illustrated exemplary embodiment, inner hollow passage 72 is shown with a larger cross-section than the outer hollow passages 70, 74. In embodiments, the second set of exterior posts are also spaced approximately 180 degrees from one another.

Figure 1B:
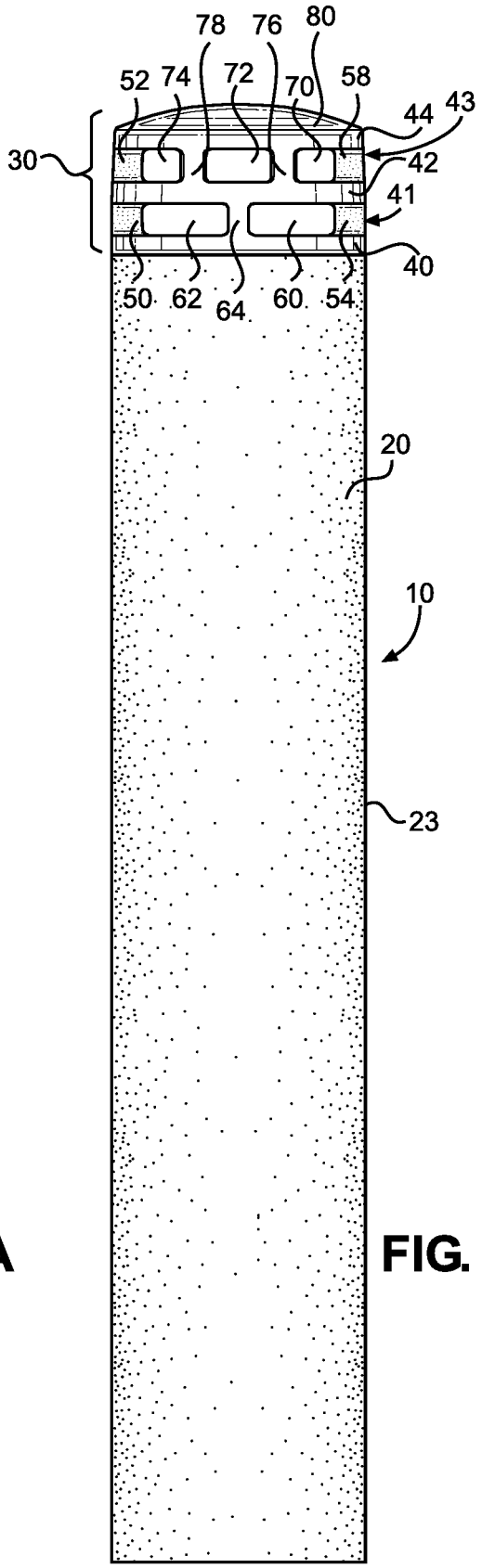
FIG. 1B is a plan view of the dart rotated 180 degrees from the angular orientation shown in FIG. 1A in accordance with an embodiment of the present invention.

Further referring to FIGS. 1A and 1B, interior walls 64, 76, 78 are generally vertical and may be substantially uniform in thickness or may slightly taper toward the center of cap 30. For example, where dart cap 30 is approximately 12.5 mm or approximately 12.7 mm in diameter, each interior wall may have a thickness that is within a range of 0.8 to 1.4 mm or is, more preferably, within a range of 1.2 to 1.4 mm with a possible taper from 1.4 to 1.2 mm in a direction from the outside of dart cap 30 toward the center of the dart cap. Second and third interior walls 76, 78 are in respective positions that are offset laterally from a position of the first interior wall 64 such that first interior wall 64 is not substantially in alignment with second or third interior walls 76, 78. However, the second set of two exterior posts 52, 58 are substantially in alignment with the respective exterior posts 50, 54 of the first set of two exterior posts 50, 54. In other words, exterior posts 50, 52 are substantially in alignment with one another vertically on an outer surface of dart cap 30 and exterior posts 54, 58 are substantially in alignment with one another vertically on the outer surface of dart cap 30. Thus, the combination of exterior posts 52 and 50 may be considered as a single exterior post while the combination of exterior posts 58 and 54 may likewise be considered as another single exterior post.

In exemplary embodiments, dart cap 30 may be integrally formed, such as by injection molding. In alternative exemplary embodiments, dart cap 30 may be formed of one or more pieces.

When viewed from the angular orientations of dart 10 in FIGS. 1A and 1B, in the illustrated embodiment, hollow passages 60, 62, 70, 74, 76 are substantially rectangular in cross-section, as provided by the substantially vertical exterior posts and interior walls and substantially flat surfaces of the top of the first tier 40, the bottom and top of second tier 42, and the bottom of third tier 44.

The tiered-structure of dart cap 30 provides a substantially cylindrically-shaped outer surface that extends from the top to the bottom of the dart cap 30 in the longitudinal direction of dart 10 but with two layers of hollow passages passing through the sides of dart cap 30. These layers include first, lower layer 41 having hollow passages 60, 62, exterior posts 50, 54 and a lower layer interior boundary between hollow passages 60, 62, such as interior wall 64, and a second, upper layer 43 having hollow passages 70, 72, 74, exterior posts 52, 58, and upper layer interior boundaries between hollow passages 70, 72, 74, such as interior walls 76, 78. Each of the hollow passages 60, 62, 70, 72, 74 extends from a respective first opening on the substantially cylindrically-shaped outer surface through the dart cap 30 in a direction y that is substantially orthogonal to the longitudinal direction x of the elongate dart body 20, to a respective second opening on the substantially cylindrically-shaped outer surface. Layers 41 and 43 are separated by the substantially flat second tier 42 that serves as a divider between the two layers 41, 43 and as a top of lower layer 41 and a bottom of upper layer 43. The hollow passages provide spaces that allow dart cap 30 to deform upon impact.

While two sets of exterior posts are provided in the illustrated embodiment, in other exemplary embodiments, additional exterior posts may be provided, possibly in lieu of one or more interior walls. For example, instead of having an interior wall 64 in lower layer 41 of dart cap 30, at least four exterior posts may be provided as support for lower layer 41, where at least two additional exterior posts are provided to serve as interior boundaries between hollow passages 60, 62 in lieu of interior wall 64. This would ensure that there would be support for lower layer 41 at approximately every 90 degrees about the circumference of dart cap 30. A similar substitution of exterior posts for one or more interior walls of upper layer 43 might be made in lieu of or in addition to the substitution of posts in lower layer 41.

The top 80 of dart cap 30 may be substantially flat, may be tapered, may be curved, such as in the shape of a spherical segment, spherical frustum, or spherical dome, or may have some other shape. Providing a taper or curved top that adds material to the top of dart 10 may enhance the aerodynamic profile of the dart cap to improve the speed and accuracy of the dart and lengthen the distance over which dart 10 can travel.

Figure 2A:
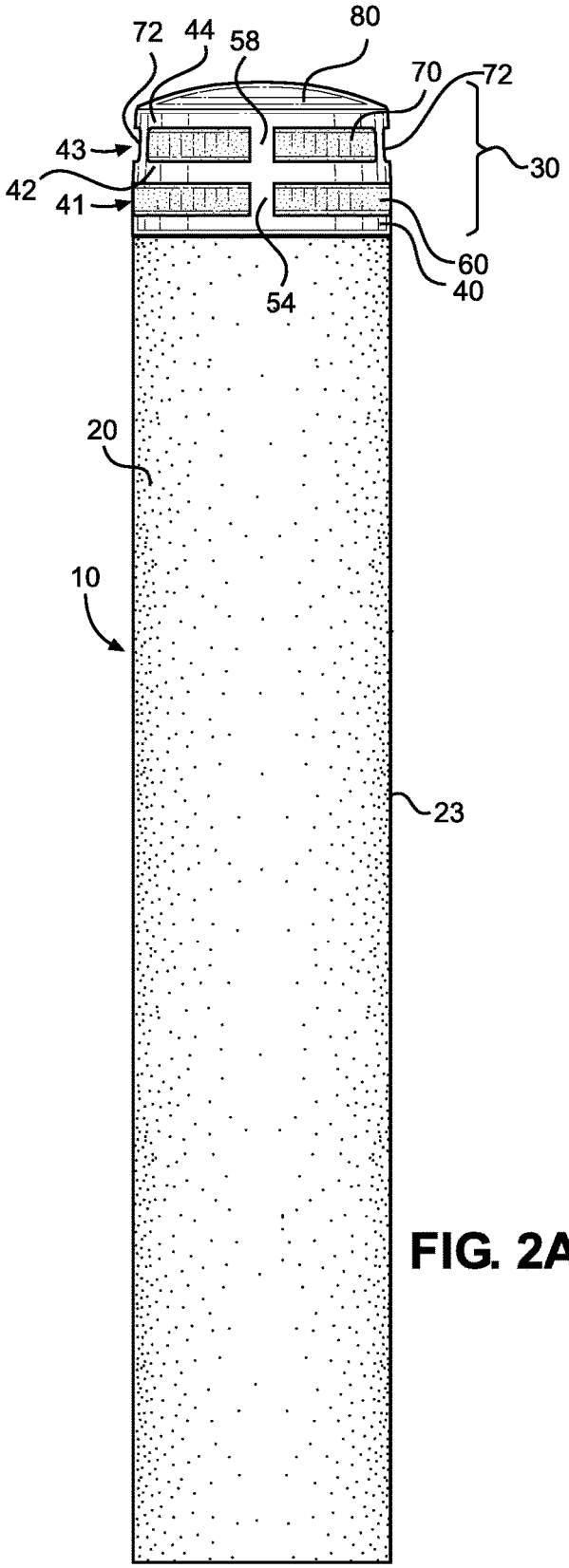
FIG. 2A is a plan view of the dart rotated 90 degrees clockwise from the angular orientation shown in FIG. 1A in accordance with an embodiment of the present invention.
Figure 2B:
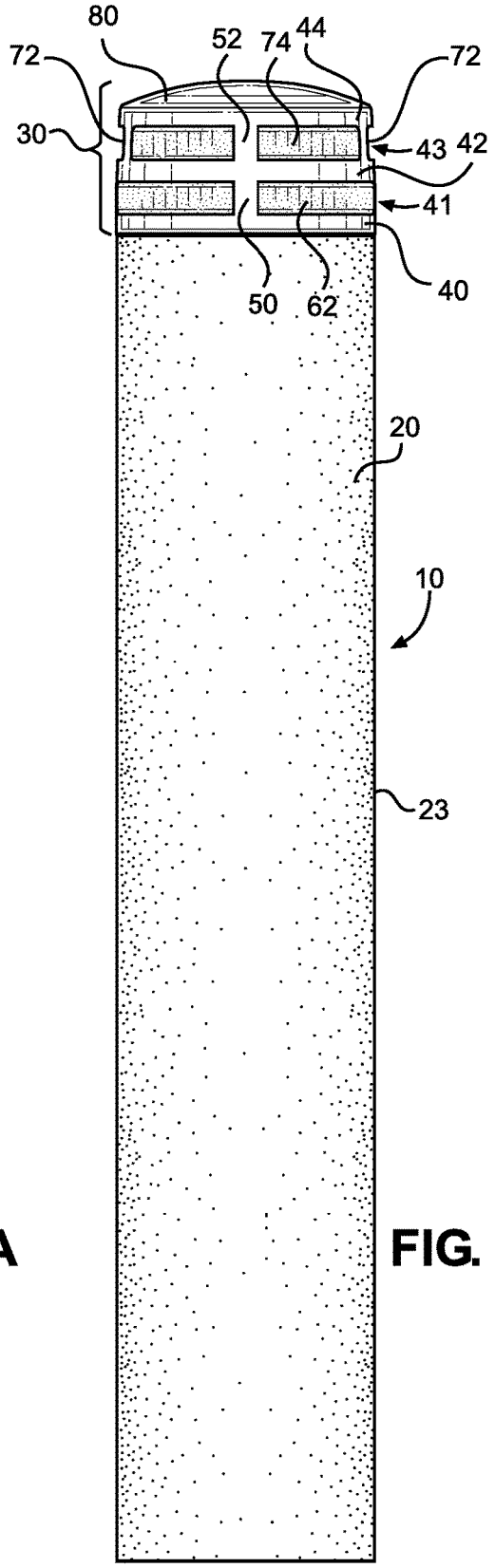
FIG. 2B is a plan view of the dart rotated 90 degrees counterclockwise from the angular orientation shown in FIG. 1A in accordance with an embodiment of the present invention.

FIGS. 2A and 2B further illustrate the exemplary embodiment of the present invention, with FIG. 2A being a plan view of the dart rotated 90 degrees clockwise from the angular orientation shown in FIG. 1A and with FIG. 2B being a plan view of the dart rotated 90 degrees counterclockwise from the angular orientation shown in FIG. 1A. FIG. 2A shows the outer hollow passages 60, 70 as passing laterally from openings on the side of dart cap 30 to other openings on the side of dart cap 30 and FIG. 2B shows outer hollow passages 62, 74 similarly passing laterally through openings in the side of dart cap 30. Also visible in FIGS. 2A and 2B are opposite ends of inner hollow passage 72. Each of exterior posts 50, 52, 54, 58 are spaced approximately 90 degrees from interior wall 64 that is located substantially midway between the exterior posts. This provides support for the lower layer 41 radially at approximately every 90 degrees about a circumference of dart cap 30. Due to the placement of the interior walls 64, 76, 78, one viewing the dart 10 from either angular orientation shown in FIGS. 1A and 1B is able to see through the dart cap 30 from one side to the other. By contrast, in viewing the dart 10 from the angular orientations of FIGS. 2A and 2B, a viewer cannot see through the dart cap 30.

Figure 3B:
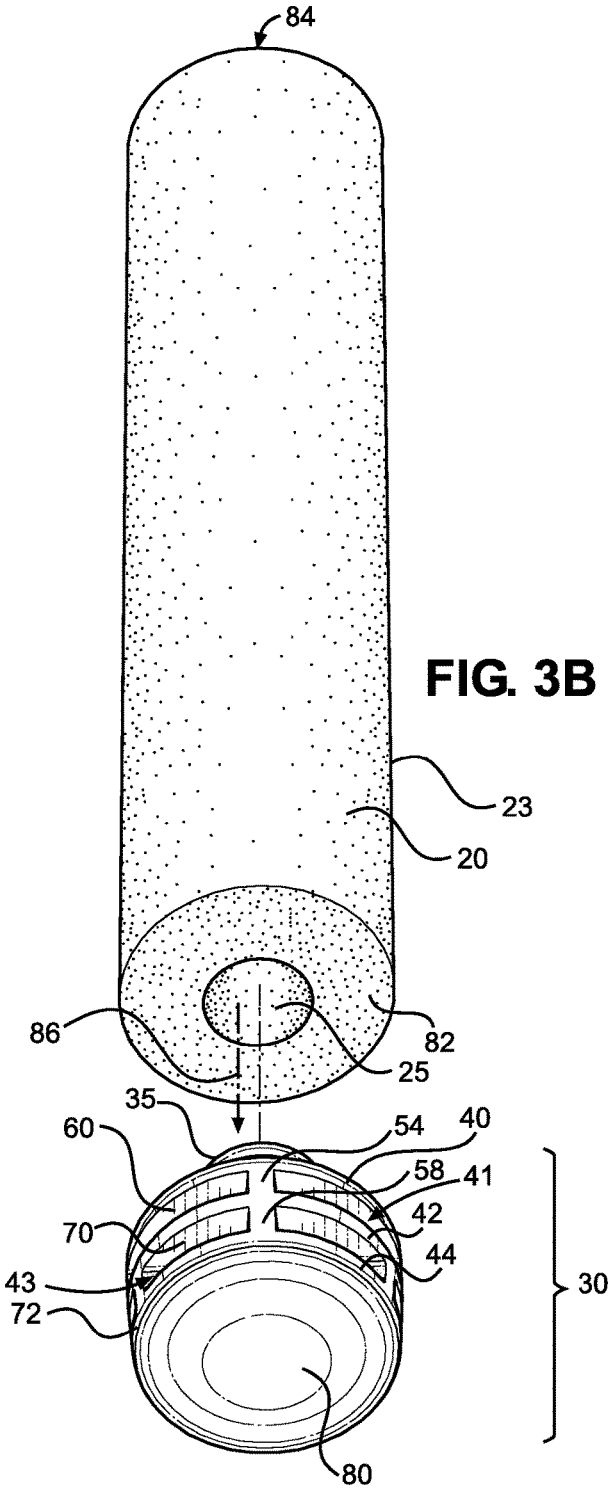
FIG. 3B is an exploded view of the dart, including a dart body and dart cap, shown from a second perspective with the dart cap in the orientation of FIG. 2A in accordance with an embodiment of the present invention.

The exploded views of FIGS. 3A and 3B highlight additional features of dart cap 30. In particular, FIG. 3A illustrates a dart cap 30 that includes a stem 35 at the bottom of cap 30 that is insertable into interior bore 25 of dart body 20 to affix cap 30 to dart body 20. Stem 35 may be formed integrally with dart cap 30 or may be attached thereto, and may be formed of one or more pieces.

In embodiments, cap 30 is affixed to dart body 20 with an adhesive, such as a glue, that may be applied around stem 35, inside the interior bore 25, and/or to a bottom of first tier 40 of dart cap 20. To provide additional surface area on dart cap 30 to more strongly affix cap 30 to dart body 20, stem 35 may include one or more grooves, such as grooves 37 and 39 that can accommodate additional adhesive. In embodiments, dart cap 30 may be affixed to dart body 20 in a manner other than with an adhesive.

Although stem 35 is illustrated with a particular design, it should be understood that the stem 35 for dart cap 30 is not limited to the illustrated design, and may be shaped and/or sized differently. For example, there may not be any grooves and stem 35 may have an enlarged plug attached to the bottom of stem 35 to help hold stem 35 within interior bore 25.

Dart cap 30 is made to be heavier than the relatively lightweight configuration of dart body 20, such as by providing the various structures (e.g., exterior posts, interior walls, thicker material top 80 (e.g., dome shape)) and by choosing a particular composition of material, so as to position the center of gravity of dart 10 toward the head of the dart 10. This improves the accuracy and aerodynamics of dart 10.

Figure 4:
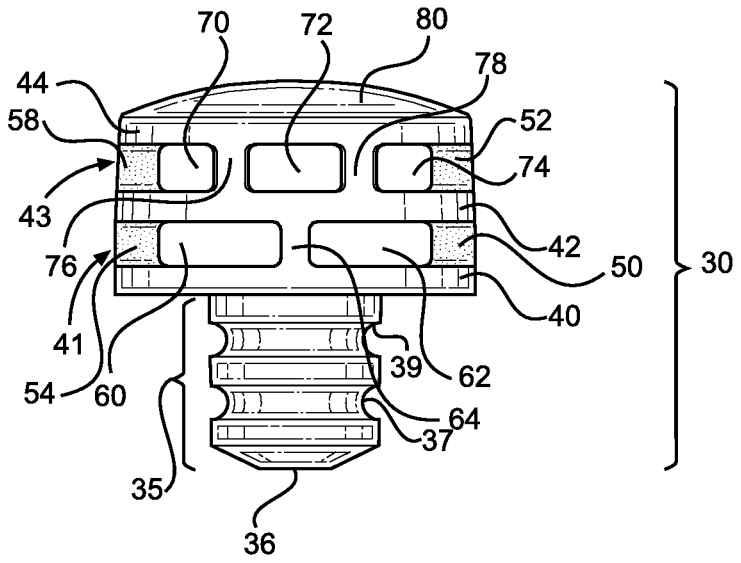
FIG. 4 is an enlarged plan view of the dart cap without the dart body shown in the orientation of FIG. 1A in accordance with an embodiment of the present invention.
Figure 5:
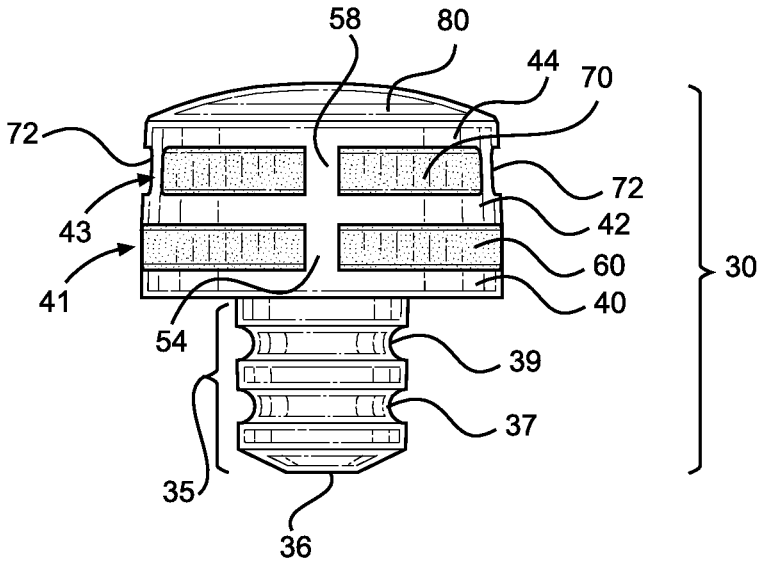
FIG. 5 is an enlarged plan view of the dart cap without the dart body shown in the orientation of FIG. 1B in accordance with an embodiment of the present invention.

FIG. 4 shows an enlarged view of dart cap 30 with a first angular orientation as shown in FIG. 1A. FIG. 5 shows an enlarged view of dart cap 30 with a second angular orientation as shown in FIG. 2A. As will be understood from these figures, hollow passages 60, 62, 70 and 74 are not fully surrounded along the length of the passages. Rather, exterior posts 50, 52, 54, 58 are generally relatively narrow compared to the diameter of dart cap 30 and only enclose a short distance of one side of those passages on the exterior. For example, where dart cap 30 is approximately 12.5 mm or approximately 12.7 mm in diameter, interior walls 64, 76, 78 may extend for as long as the full diameter of cap 30, whereas the exterior posts may be within a range of between 1.2 to 1.4 mm in width.

It should be understood that, as with the dimensions of elongate dart body 20, the dimensions of dart cap 30 and structures thereof may vary. For example, in embodiments, the height of dart cap 30 excluding the height of stem 35 may be in a range of 6-9 mm, stem 35 has a length, such as a length of at least 5 mm, and a diameter that is sized to fit and securely hold dart cap 30 within interior bore 25, and grooves 37, 39 within stem 35 may be in a range of 0.5 to 0.7 mm. However, in embodiments, dart cap 30 and structures thereof may have different dimensions, such as different lengths, heights, widths, and/or diameters.

In embodiments, dart cap 30 is made of a soft, flexible and/or resilient material, that can be injection molded. For example, dart cap 30 may be made of injection molded thermoplastic rubber (TPR). In embodiments, cap 30 could alternatively be made of, for example, polyvinyl chloride (PVC), styrene-butadiene-styrene (SBS), or ethylene-vinyl acetate (EVA), to name a few.

In embodiments, dart cap 30 has a Shore durometer measurement that is sufficiently rigid to maintain the integrity of the cap but relatively soft to lessen the impact on a target.

In embodiments, the molding material may have a Shore A durometer that is within a range of 15 to 80. In embodiments, the molding material may have a Shore A durometer that is within a range of 20 to 80, or a range of 20 to 70, or a range of 40 to 70, or a range of 20 to 60, or a range of 30 to 60, or a range of 20 to 40, to name a few. In embodiments, the molding material may have a Shore A durometer that is approximately 30, or approximately 40, or approximately 50, or approximately 70, to name a few. In embodiments, the molding material may have a Shore A durometer that is at least 20, or at least 30, or at least 40, to name a few. In embodiments, the molding material may have a Shore A durometer that is no more than 80, or no more than 70, or no more than 50, to name a few.

In embodiments, the cap may have a Shore A durometer that is within a range of 15 to 80, or a range of 20 to 80, or a range of 20 to 70, or a range of 40 to 70, or a range of 20 to 60, or a range of 30 to 60, or a range of 20 to 40, to name a few. In embodiments, the cap may have a Shore A durometer that is approximately 30, or approximately 40, or approximately 50 or approximately 70, to name a few. In embodiments, the cap may have a Shore A durometer that is at least 20, or at least 30, or at least 40, to name a few. In embodiments, the cap may have a Shore A durometer that is no more than 80, or no more than 70 or no more than 50, to name a few.

In embodiments, dart cap 30 may be measured along a different Shore durometer scale, such as Shore D, for example.

Figure 6:
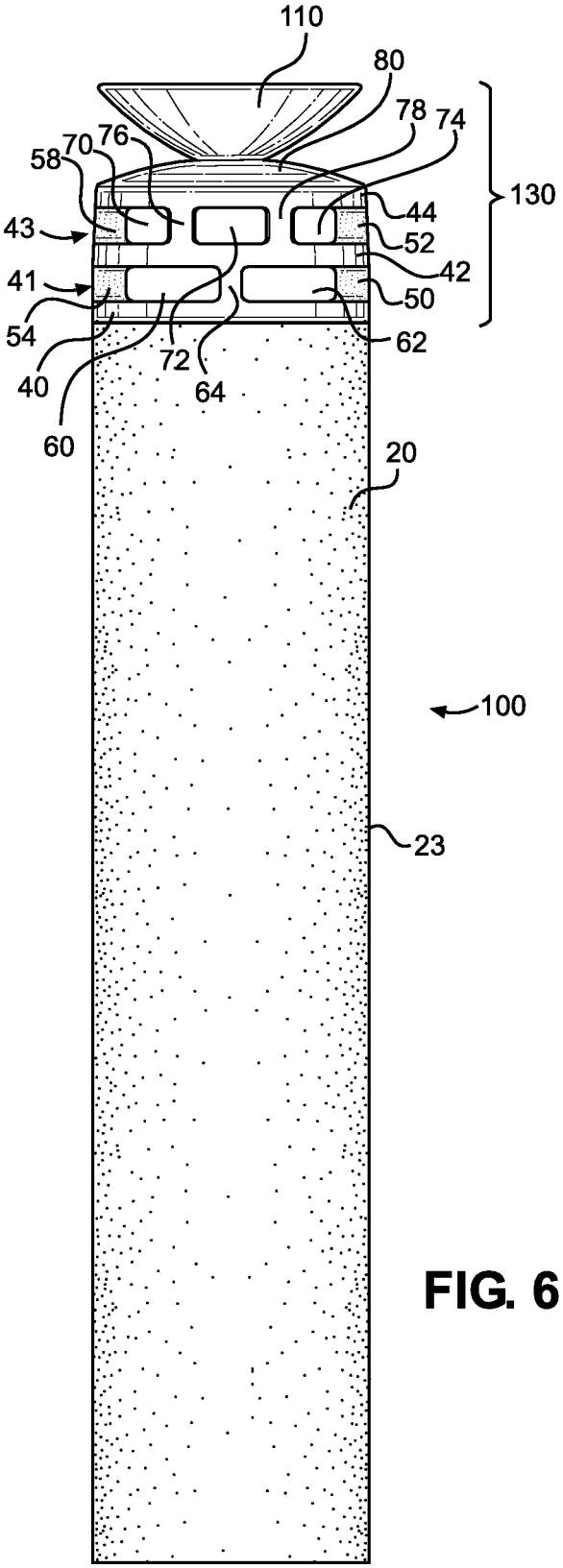
FIG. 6 is a plan view of a dart in accordance with a second embodiment of the present invention where the dart cap has a suction cup at the top of the cap.

FIG. 6 illustrates a foam dart in accordance with another exemplary embodiment of the present invention. In this embodiment, dart 100 has an elongate dart body 20 with a cap 130 that may be identical to dart cap 30 but also has another element attached to the top of cap 130, which is represented in FIG. 6 as a suction cup 110 at the top 80 of cap 130. This additional element added to cap 130 may be formed integrally with cap 130 or attached thereto, such as by adhesive, and allow for additional functionality. For example, the illustrated suction cup 110, allows dart 100 to at least temporarily attach onto a target object. Although FIG. 6 illustrates a representative element, e.g., suction cup 110 attached to a curved top 80, in embodiments, dart 110 may have a flat top on which suction cup 110 or some other additional element is formed or attached.

Figure 7C:
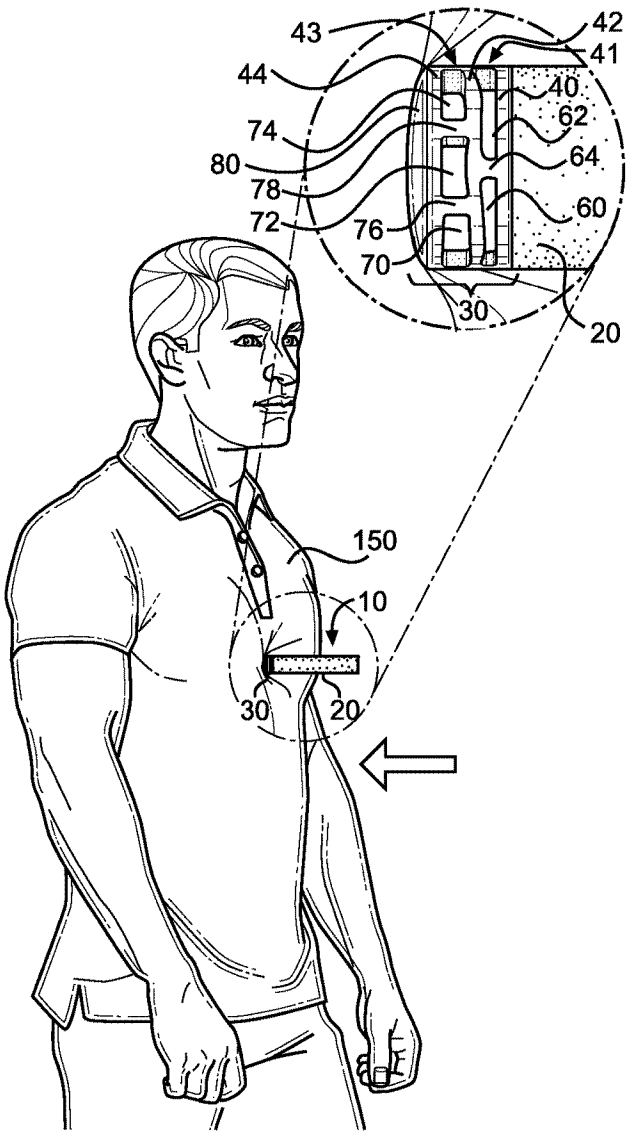
FIG. 7C shows an example of how the cap of the toy dart of FIG. 7A may deform upon impact.
Figure 7B:
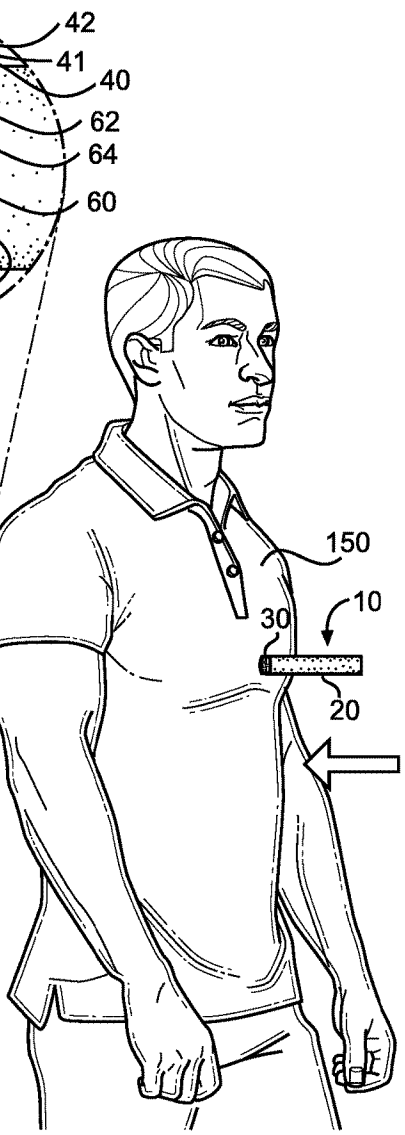
FIG. 7B shows the toy dart of FIG. 7A on initial impact on the person.
Figure 7A:
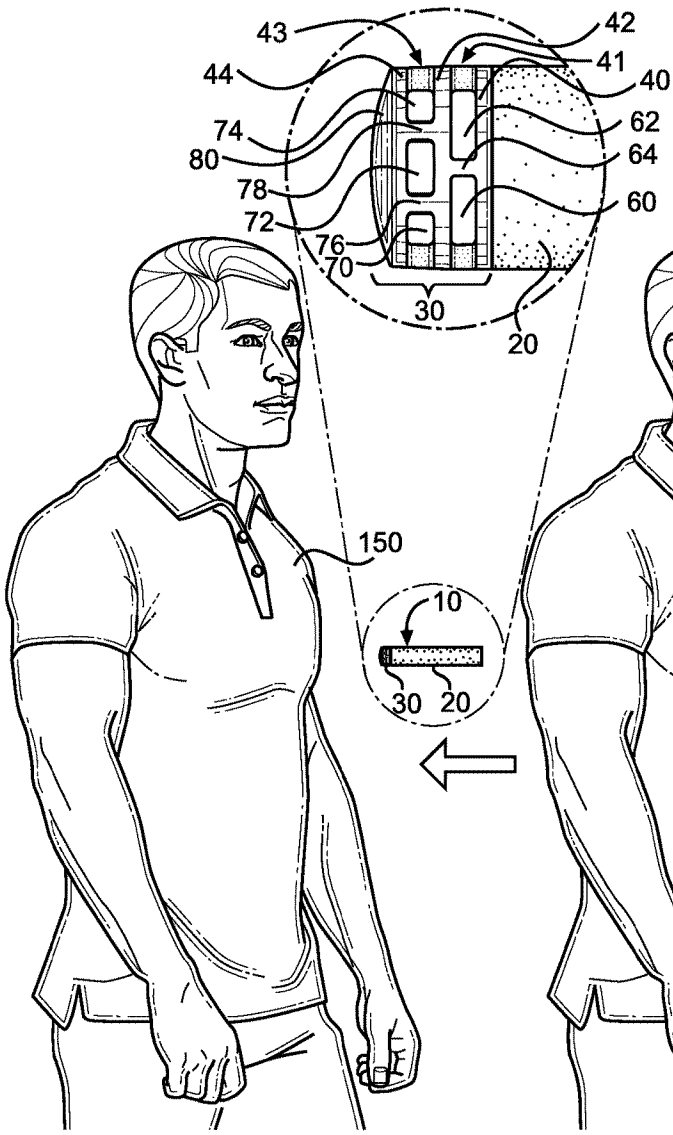
FIG. 7A shows the toy dart in accordance with an embodiment of the invention on an incoming path toward a targeted person.

FIGS. 7A to 7C illustrates an exemplary launch of dart 10 (or dart 100) toward a person from a compatible toy dart launcher (not shown). The compatible toy dart launcher may launch dart 10 by forcing air or some other material 86, such as another gas or liquid, through the bottom of interior bore 25 at the tail end of elongate dart body 20, as shown in FIG. 3A. The forced air or other material impinges upon the bottom 36 of stem 35 and causes the launch of the dart 10 toward a target. As shown in FIG. 7A, dart 10 has been launched and comes into proximity with a person 150. At FIG. 7B, dart 10 impacts upon and makes contact with the person's shirt. At FIG. 7C, dart 10 presses into person 150, with dart cap 30 deforming so as to safely soften the impact on the person and at least limit injuries that may be caused by the impact. As can be seen in the enlarged view within FIG. 7C, lower layer 41 of dart cap 30 deforms more than upper layer 43 upon the initial impact of dart 10, with hollow passages 60, 62 deforming more than hollow passages 70, 72, 74. This is because lower layer 41 has only a single interior wall 64 whereas upper layer 43 has two interior walls 76, 78. After impacting the person, dart 10 bounces off and dart cap 30 may resiliently substantially return to its original shape, such as for relaunching. Although not shown, it should be understood that the lightweight material, such as foam, of dart body 20 may also deform to a certain extent upon impact. It is desirable that upper layer 43 remain more rigid than lower layer 41 so that dart 10 does not wobble or deform much during flight, which would affect the accuracy of dart 10 in hitting its intended target.

While the above embodiments are described as having two hollow passages in a lower layer and three hollow passages in an upper layer, it is also possible, in embodiments, to have additional hollow passages in the upper layer and/or the lower layer of the dart cap where the hollow passages are separated by one or more additional interior walls or are demarcated by additional exterior posts. The inclusion of additional structures would change the aerodynamics, the weight, and/or the rigidity of the dart cap. Where additional hollow passages are provided, in embodiments, the upper layer of the dart cap should have more hollow passages than the lower layer with the interior walls of the upper layer offset from the interior walls of the lower layer to allow the lower layer to deform more while maintaining a desired rigidity of the upper layer. Changes to the dart cap design may take into account the complexity of the mold that is required, the cost for additional materials, and any increased weight and for rigidity of the toy dart, which may impact the aerodynamics and safety of the toy dart.

While particular embodiments of the present invention have been shown and described in detail, it would be obvious to those skilled in the art that various modifications and improvements thereon may be made without departing from the spirit and scope of the invention. It is therefore intended to cover in the appended claims all such modifications and improvements that are within the scope of this invention.

What is claimed is:

1. A toy dart, comprising:

an elongate dart body extending from a head end to a tail end in a first, longitudinal direction; and a deformable dart cap affixed to the head end of the elongate dart body, the deformable dart cap having a top, a bottom that is affixed into the elongate dart body, and an outer surface extending from the top to the bottom of the deformable dart cap in the first, longitudinal direction;

wherein the outer surface of the deformable dart cap comprises two layers of openings that are respectively separated by interior walls that extend in a second direction, wherein the second direction is substantially orthogonal to the first, longitudinal direction of the elongate dart body, the two layers of openings comprising:

(1) a lower layer, which abuts the bottom of the deformable dart cap, comprising at least one lower layer interior wall extending through the deformable dart cap separating a first lower layer opening and a second lower layer opening;

(2) an upper layer, above the lower layer in relation to the top of the deformable dart cap, comprising at least two upper layer interior walls extending through the deformable dart cap, two of the at least two upper layer interior walls separating a first upper layer opening from a second upper layer opening and a third upper layer opening, respectively; and (3) at least two exterior posts that extend in the first, longitudinal direction along opposite sides of the outer surface in alignment between the lower layer and the upper layer, the at least two exterior posts being spaced away from the at least one lower layer interior wall and the at least two upper layer interior walls, wherein the at least two upper layer interior walls are offset in position laterally from the at least one lower layer interior wall.

2. The toy dart of claim 1, wherein the first and second lower layer openings form respective first and second lower layer hollow passages between the at least one lower layer interior wall and respective ones of the at least two exterior posts, the first and second lower layer hollow passages extending through the deformable dart cap to respective third and fourth lower layer openings on the outer surface of the deformable dart cap opposite to the first and second lower layer openings in the second direction.

3. The toy dart of claim 2, wherein the first and second lower layer hollow passages are approximately equal in cross section.

4. The toy dart of claim 3, wherein the two exterior posts are spaced approximately 180 degrees from one another, and wherein the at least one lower layer interior wall is located substantially midway between the two exterior posts such that there is support for the lower layer radially at approximately every 90 degrees about a circumference of the deformable dart cap.

5. The toy dart of claim 2, wherein the first, second, and third upper layer openings form respective first, second, and third upper layer hollow passages, which extend through the deformable dart cap to respective fourth, fifth, and sixth upper layer openings on the outer surface of the deformable dart cap opposite to the first, second, and third upper layer openings in the second direction, and wherein the first, second, and third upper layer hollow passages are substantially parallel to one another.

6. The toy dart of claim 5, wherein two outer hollow passages of the first, second and third upper layer hollow passages are approximately equal in cross-section, and wherein an inner hollow passage of the first, second, and third upper layer hollow passages has a larger cross section than each of the respective cross sections of the two outer hollow passages.

7. The toy dart of claim 1, wherein the at least one lower layer interior wall is positioned in the lower layer to be laterally offset from the two upper layer interior walls in the upper layer such that the lower layer of the deformable dart cap is configured to compress more than the upper layer of the deformable dart cap upon initial impact of the top of the deformable dart cap on a person or on an object.

8. The toy dart of claim 7, wherein the at least one lower layer interior wall is positioned below and substantially midway between the two upper layer interior walls.

9. The toy dart of claim 1, wherein the first, second, and third upper layer openings are in an aligned row on the upper layer.

10. The toy dart of claim 1, wherein the elongate dart body is substantially cylindrical.

11. The toy dart of claim 1, wherein the top of the deformable dart cap is curved.

12. The toy dart of claim 11, wherein the top of the deformable dart cap is shaped as a spherical segment, spherical frustum, or spherical dome.

13. The toy dart of claim 1, wherein the top of the deformable dart cap is substantially flat.

14. The toy dart of claim 1, wherein the deformable dart cap further comprises a suction cup at the top of the deformable dart cap.

15. The toy dart of claim 1, wherein the top of the deformable dart cap has a diameter of approximately 12.5 mm.

16. The toy dart of claim 1, wherein the deformable dart cap comprises thermoplastic rubber (TPR) that is injection molded.

17. The toy dart of claim 1, wherein the upper layer of the deformable dart cap has a greater number of openings and interior boundaries than the lower layer of the deformable dart cap such that the upper layer is more rigid than the lower layer.

18. The toy dart of claim 1, wherein the elongate dart body comprises foam.

19. The toy dart of claim 1, wherein at least one of the first lower layer opening, the second lower layer opening, the first upper layer opening, the second upper layer opening, and the third upper layer opening is substantially rectangular in cross-section.

20. The toy dart of claim 1, wherein the at least two exterior posts are parallel with one another on the outer surface across the lower layer and the upper layer of the deformable dart cap.

* * * * *